United States Patent [19]

Kosowsky

[11] 4,405,432

[45] Sep. 20, 1983

[54] PLATING HEAD

[75] Inventor: Lex A. Kosowsky, Santa Clara, Calif.

[73] Assignee: National Semiconductor Corporation, Santa Clara, Calif.

[21] Appl. No.: 436,090

[22] Filed: Oct. 22, 1982

[51] Int. Cl.[3] ..... C25D 17/00; C25D 21/10

[52] U.S. Cl. ..... 204/206; 204/224 R

[58] Field of Search ..... 204/206, 224 R

[56] References Cited

U.S. PATENT DOCUMENTS 3,723,283 3/1973 Johnson ..... 204/224 R 4,030,999 6/1977 Allen ..... 204/224 R

FOREIGN PATENT DOCUMENTS 2508777 9/1976 Fed. Rep. of Germany ... 204/224 R 3015282 10/1981 Fed. Rep. of Germany ... 204/224 R

*Primary Examiner*—T. M. Tufariello

*Attorney, Agent, or Firm*—Paul J. Winters; Gail W. Woodward; Michael J. Pollock

[57] ABSTRACT

A plating head for spot plating a web of moving material that plates faster due to a large planar electrode that faces the plating area and a system of electrolyte channels that inject electrolyte at a high rate from the side of the electrode into the space between the electrode and the plating area.

3 Claims, 1 Drawing Figure

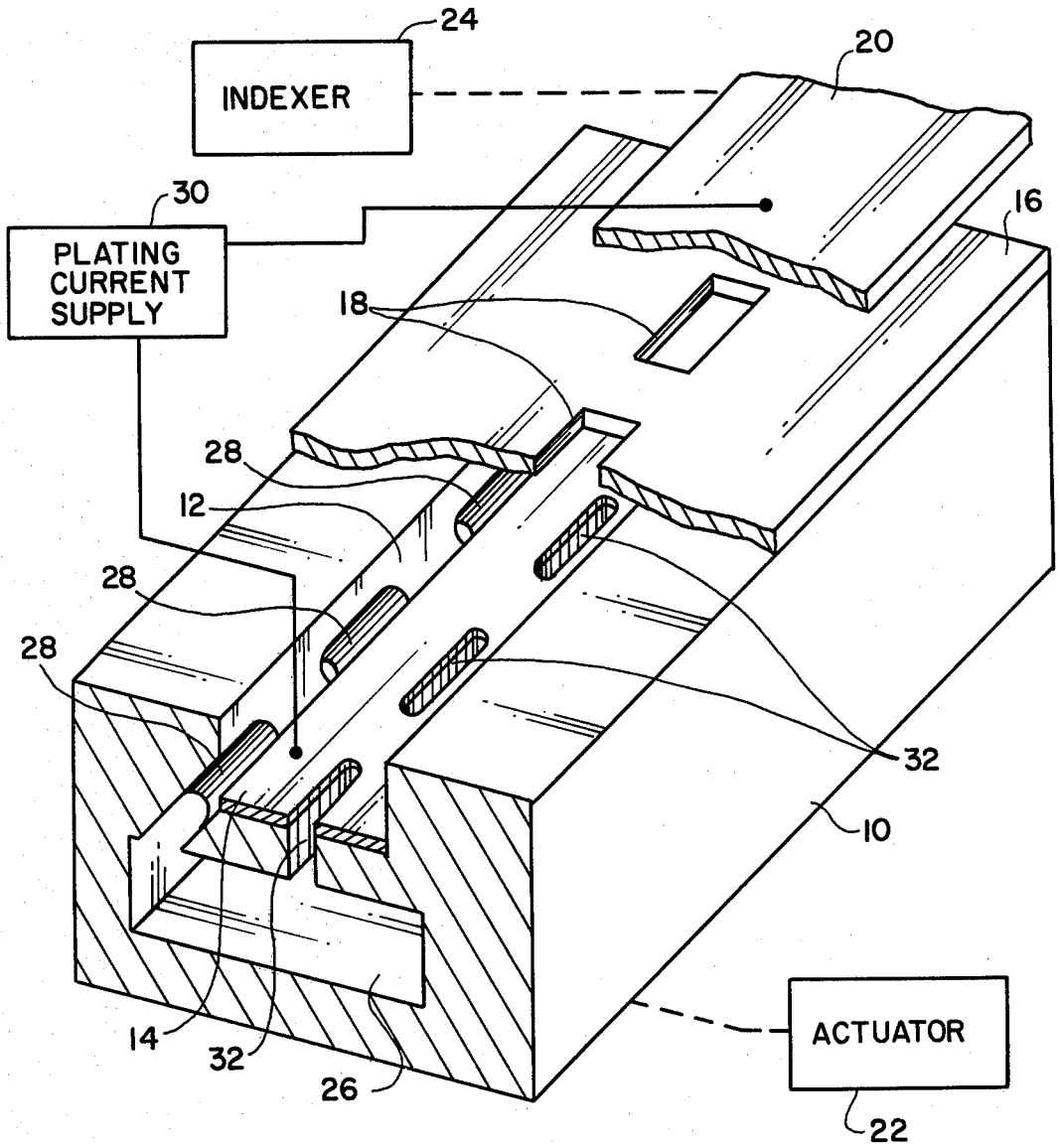
24
INDEXER
20
30
PLATING
CURRENT
SUPPLY
16
18
28
12
28
28
32
10
14
32
26
ACTUATOR
22

PLATING HEAD

BACKGROUND OF THE INVENTION

This invention relates to metal spot plating systems of the type disclosed in U.S. Pat. No. 3,723,283. This patent is herein incorporated by reference for its overall teachings of mechanisms to incrementally move a strip or web of metal through a plating head. When the web stops for an interval, plating heads close about and seal the web. A system of passageways and manifolds in the heads convey electrolyte plating fluid against the surface of the web. Apertured masks positioned between the web and the mask insure that plating fluid contacts the web only in the exact areas exposed by the apertures.

Throughput and efficiency are maximized by plating the selected areas as quickly as possible. Fast plating requires large quantities of electrolyte to flow over the work so as to refresh the metal ion supply. U.S. Pat. No. 3,723,283 discloses what has now become the standard configuration for directing a large flow of electrolyte at the area to be plated, namely, passageways positioned generally perpendicular to the web so as to spray electrolyte at the web with high flow rates.

It is also necessary to conduct electricity through the electrolyte. Typically the web is grounded and a positive wire or screen electrode is placed in the path of the electrolyte. This anode must be kept relatively small, however, so as to avoid blocking the flow of electrolyte. The present invention contemplates an improved arrangement.

SUMMARY OF THE INVENTION

Briefly, a large planar positive electrode is taught herein, positioned in close facing relationship to the mask apertures. By using an electrode with a much larger distributed conducting face, larger and more even current densities are effected which result in faster and higher quality plating. Normally such large electrodes would be impractical in that they block the flow of electrolyte. The instant invention overcomes this problem with special manifold designs that inject electrolyte from the side of the head at an angle appropriate to impact the areas to be plated. If desired, additional passageways may be used through the center of the planar electrode to enhance the turbulence of the flow.

BRIEF DESCRIPTION OF THE DRAWING

A schematic perspective view of the plating head of my invention is shown in section with the mask and the web cut back to better see the planar electrode and the passageway design.

DESCRIPTION OF THE PREFERRED EMBODIMENT

The plating system utilizes an electrode support member 10 with a recess 12 within which lie one or more planar electrodes 14. A mask 16 having several apertures 18 is carried by support 10 into sealing contact with a web 20 when moved by any suitable actuator 22. Web 20 is periodically advanced by a conventional indexer 24. When it stops, the apertures 18 expose selected areas of web 20 to plating electrolyte which is delivered under pressure from a manifold 26. The majority of the electrolyte is sprayed from passageways 28 located along the side of recess 12 so as to enter the space between apertures 18 and electrode 14. Passageways 28 may be angled, as shown, so as to convey the electrolyte toward the apertures 18 and the exposed selected areas of web 20. Electrical current in electrode 14, from a supply 30, can flow into the electrolyte from an extended and distributed surface area which produces even and uniform plating on web 20.

To increase turbulence, smaller additional vertical passageways 32 may also be used to convey electrolyte from manifold 26 provided that the surface area of electrode 14 is not unduly diminished. Both the main passageways 28 and the smaller turbulence enhancing channels 32 are preferably located at positions corresponding to the apertures 18 so as to concentrate a fresh flow of electrolyte on each selected area.

I claim:

1. A system for plating selected areas of a web of material comprising:

a plating head of electrically insulating material and having a recessed channel therein;

masking means operable to sealingly engage said web, said masking means having apertures so as to expose said selected areas to an electrolyte solution, said masking means disposed adjacent said plating head and over said recessed channel with said apertures in communication with said recessed channel;

an electrode in the bottom of said channel, said electrode having an extended generally planar continuous conducting surface positioned generally parallel to the masking means so as to expose the surface maximally to said apertures;

first passageways in said plating head adapted to convey the major portion of the electrolyte into the space between said apertures and said electrode surface, said first passageways opening in the side of said recessed channel so as to supply fresh electrolyte along the length of the channel;

second passageways to convey electrolyte through small openings in said surface of the electrode so as to enhance turbulent flow of electrolyte in said channel; and plating current supply means connected to said electrode means and to said web.

2. The system of claim 1 in which said passageways discharge electrolyte into the space between the electrode and the apertures at discrete locations along the side of the recessed channel which locations are associated with each of said apertures.

3. The system of claim 1 in which the passageways are angled so as to direct electrolyte toward said selected areas.

* * * * *